US005179790A

United States Patent [19]

Poulos

[11] Patent Number: 5,179,790

[45] Date of Patent: Jan. 19, 1993

[54] HOT AIR BOOT DRYER

[76] Inventor: Steven L. Poulos, 55 Champlain St., Port Jefferson Station, N.Y. 11776

[21] Appl. No.: 793,623

[22] Filed: Nov. 18, 1991

[51] Int. Cl.[5] ..... F26B 25/00

[52] U.S. Cl. ..... 34/104; 34/106; 34/239; 34/243 R

[58] Field of Search ..... 34/103, 104, 105, 106, 34/151, 239, 243 R, 90, 91

[56] References Cited

U.S. PATENT DOCUMENTS

| | | | |
|---|---|---|---|
| 2,076,735 | 4/1937 | Leindorf | 34/104 |
| 2,443,695 | 6/1948 | Russell | 34/104 |
| 2,614,337 | 10/1952 | Darbo | 34/104 |
| 3,154,392 | 10/1964 | Littman | 34/104 |
| 4,171,580 | 10/1979 | Vabrinskas | 34/104 |
| 4,768,293 | 9/1988 | Kaffka | 34/104 |
| 5,003,707 | 4/1991 | Chu | 34/104 |

FOREIGN PATENT DOCUMENTS

| | | | |
|---|---|---|---|
| 3346315 | 7/1985 | Fed. Rep. of Germany | 34/104 |

*Primary Examiner*—Henry A. Bennet
*Assistant Examiner*—Denise L. F. Gromada

[57] ABSTRACT

A hot air boot dryer is provided which consists of a mechanism for applying hot air within the interior and towards a toe area of a boot to remove moisture therefrom. Another mechanism is for exhausting the hot air and moisture out of the boot, so that the interior of the boot can become dry.

10 Claims, 3 Drawing Sheets

HOT AIR BOOT DRYER

BACKGROUND OF THE INVENTION

1. Field of the Invention

The instant invention relates generally to dryers and more specifically it relates to a hot air boot dryer.

2. Description of the Prior Art

Numerous dryers have been provided in prior art that are adapted to eliminate moisture from objects by plowing hot air at the objects, such as hair and clothes dryers. While these units may be suitable for the particular purpose to which they address, they would not be as suitable for the purposes of the present invention as heretofore described.

SUMMARY OF THE INVENTION

A primary object of the present invention is to provide a hot air boot dryer that will overcome the shortcomings of the prior art devices.

Another object is to provide a hot air boot dryer that will remove moisture from within the toe and foot area of a boot in a short period of time.

An additional object is to provide a hot air boot dryer that is adaptable to fit and be utilized to remove the moisture from within all types of different sized boots.

A further object is to provide a hot air boot dryer that is simple and easy to use.

A still further object is to provide a hot air boot dryer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
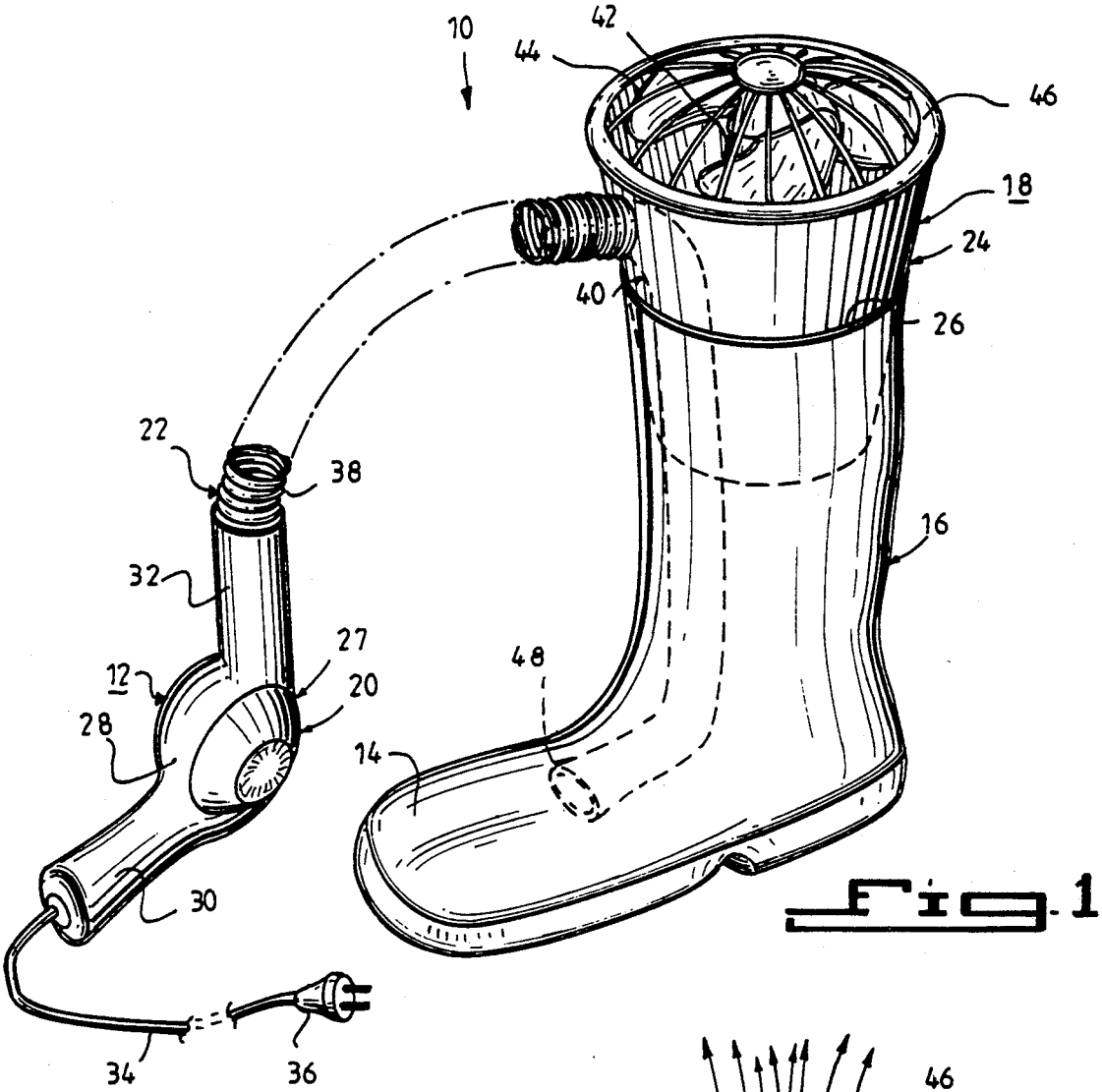
FIG. 1 is a perspective view with parts broken away of a first embodiment of the instant invention.
Figure 2:
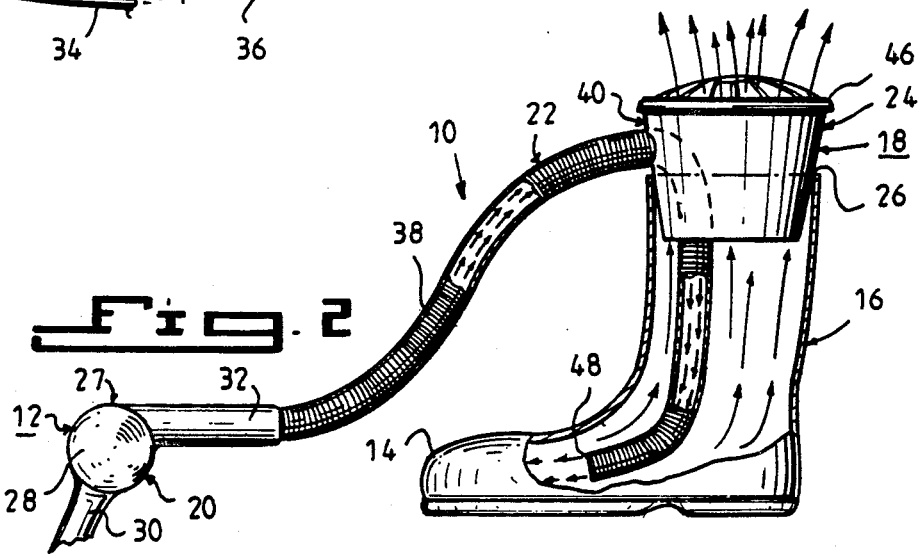
FIG. 2 is a side view with parts broken away of the first embodiment.
Figure 3:
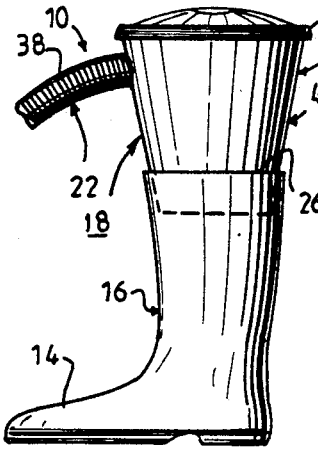
FIG. 3 is a side view showing the exhaust fan housing of the first embodiment inserted into a small boot
Figure 4:
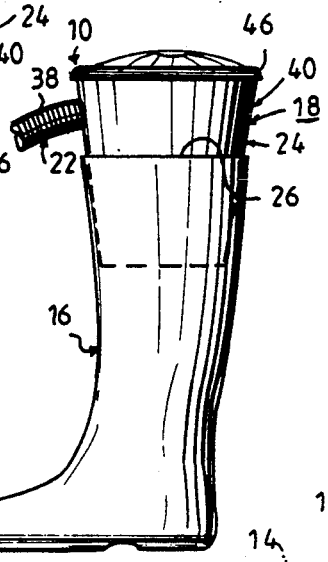
FIG. 4 is a side view showing the exhaust fan housing of the first embodiment inserted into a taller boot than shown in FIG. 3.
Figure 6:
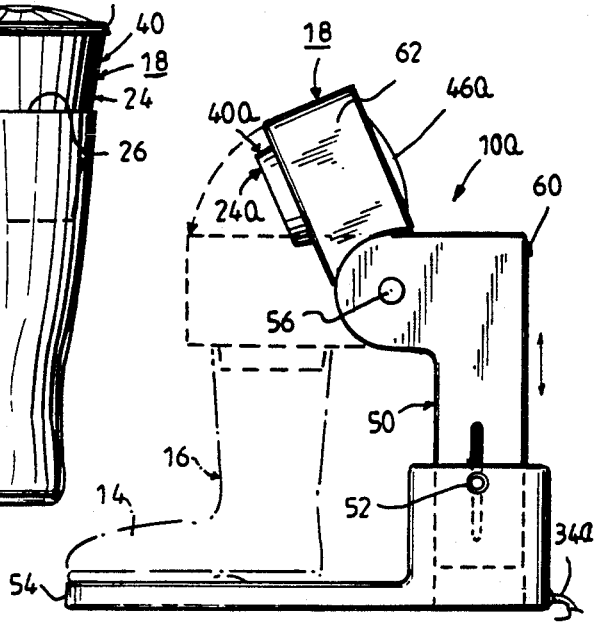
FIG. 6 is a side view of the second embodiment with the exhaust fan housing pivoted upward.
Figure 5:
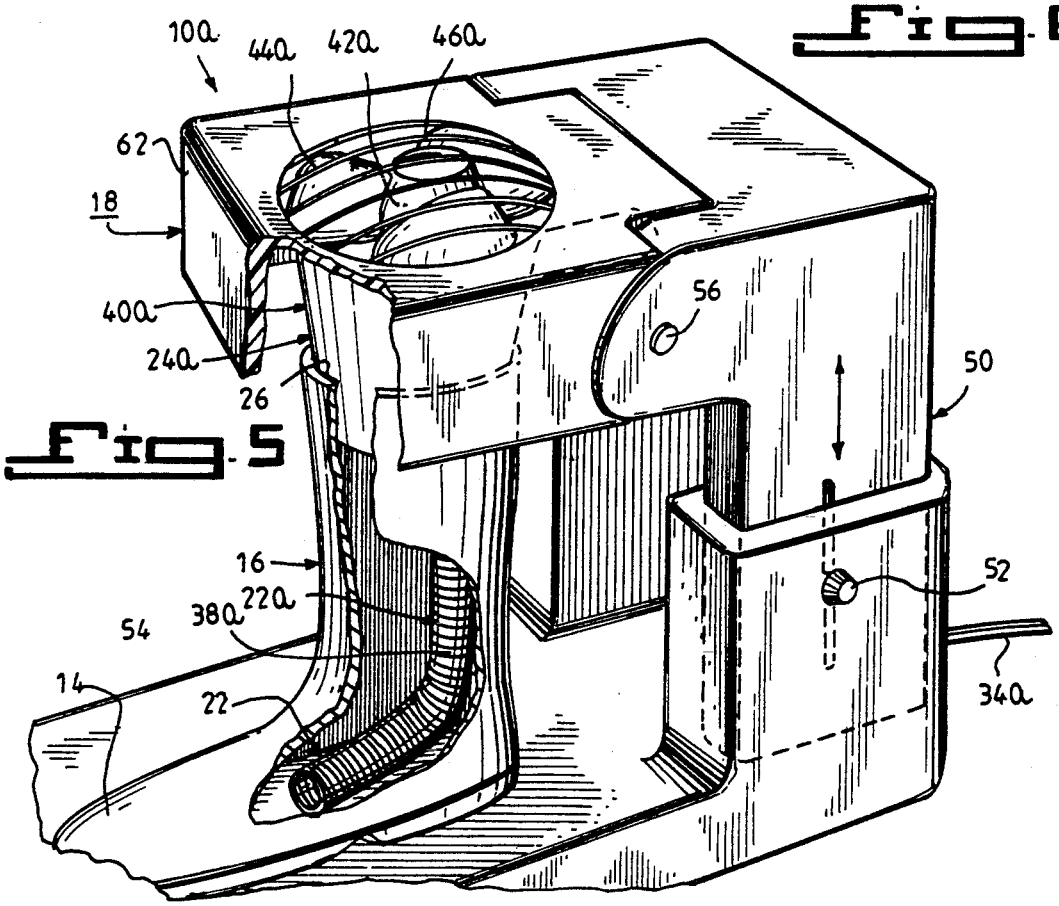
FIG. 5 is a side perspective view with parts broken away of a second embodiment of the instant invention.

Turning now descriptively to the drawings, in which similar reference characters denote similar elements throughout the several views, FIGS. 1 through 4 illustrate a hot air boot dryer 10, which consists of a mechanism 12 for applying hot air within the interior and towards a toe area 14 of a boot 16 to remove moisture therefrom. Another mechanism 18 is for exhausting the hot air and moisture out of the boot 16, so that the interior of the boot 16 can become dry.

The hot air applying mechanism 1 includes a blower 20 for producing the hot air and an elongated conduit 22 for carrying the hot air within the interior and towards the toe area 14 of the boot 16. The hot air and moisture exhausting mechanism 18 includes an exhaust fan 24 insertable into an open top of the boot 16, so as to blow the hot air and moisture out of the boot 16. The hot air blower 20 is an electric hair dryer 27 that includes a motor and heating coil housing 28. A handle 30 extends from one side of the motor and heating coil housing 28. A barrel 32 extends from another side of the motor and heating coil housing 28. An electric cord 34 is connected to a motor and heating coil (not shown) within the motor and heating coil housing 28 and extends outwardly from the bottom of the handle 30. A plug 36 on the distal end of the electric cord 34 is to connect to a power source (not shown).

The elongated conduit 22 is a flexible pipe 38 extending from an end of the barrel 32 of the electric hair dryer 27 and through the exhaust fan 24. The exhaust fan 24 includes a housing 40 to fit into the top 26 of the boot 16. A motor 42 is mounted within the housing 40, and a plurality of fan blades 44 are driven by the motor 42, while a grill 46 cover the top end of the housing 40.

The housing 40 is an inverted frustrum cone shaped configuration with the grill 46 mounted to the wide top end thereof, so that the narrow bottom end can be inserted into the open top 26 of any one of a number of all types of different sized boots 16. The lower end of the flexible pipe 38 is flared outwardly at 48 (see FIG. 1), so as to further send the hot air up into the toe area 14 within the boot 16.

Another type of hot air boot dryer **10*a* is shown in FIGS. 5 through 9, and includes a height adjustable housing to encase the hot air blower 20*a* therein. A mechanism 52 is for locking the height adjustable housing 50 in position. A base member 54 extends from the bottom of the height adjustable housing 50, so that the boot 16 can be placed upon the base member 54. A mechanism 56 is for pivoting the exhaust fan 24*a* to the top of the height adjustable housing 50, so that the exhaust fan 24*a* can pivot down into the open top 26 of the boot 16 and can pivot up to release the boot 16**.

The hot air boot dryer **10*a* further includes a rheostat 58 electrically connected to the said hot air blower 20*a*. A control knob is 60 connected to the rheostat 58 on the housing 50 for operating the rheostat 58. An electric cord 34*a* is connected to the rheostat 58 and extends outwardly from the base member 54. A plug 36*a* is on the distal end of the electric cord 34*a*** to connect to a power source (not shown).

The elongated conduit **22*a* is a flexible pipe 38*a* extending from an end of the hot air blower 20*a* and through the exhaust fan 24*a***.

The exhaust fan **24*a* includes a frame member 62 connected to the pivoting mechanism 56. A housing 40*a*** is formed on and extends downwardly from the frame member 62 to fit into the top 26 of the boot 16. A motor 42*a* is mounted within the housing 40*a*, with a plurality of fan blades 44*a* driven by the motor 42*a*. A grill 46*a* covers the top end of the housing 40*a* in the frame member 62. The housing 40*a* is also an inverted frustrum cone shaped configuration with the grill 46*a* mounted to the wide top end thereof on the frame member 62, so that the narrow bottom end can be inserted into the open top 26 of any one of a number of all types of different sized boots 16.

Figure 8:
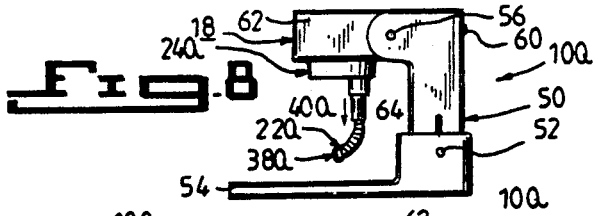
FIG. 8 is a side view of the second embodiment showing a spring biased hot air conduit extending downwardly from the exhaust fan housing.
Figure 9:
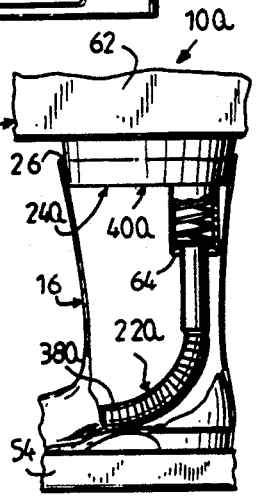
FIG. 9 is a side view in greater detail of the second embodiment with parts broken away showing the spring biased hot air conduit extending downwardly into a boot.
Figure 7:
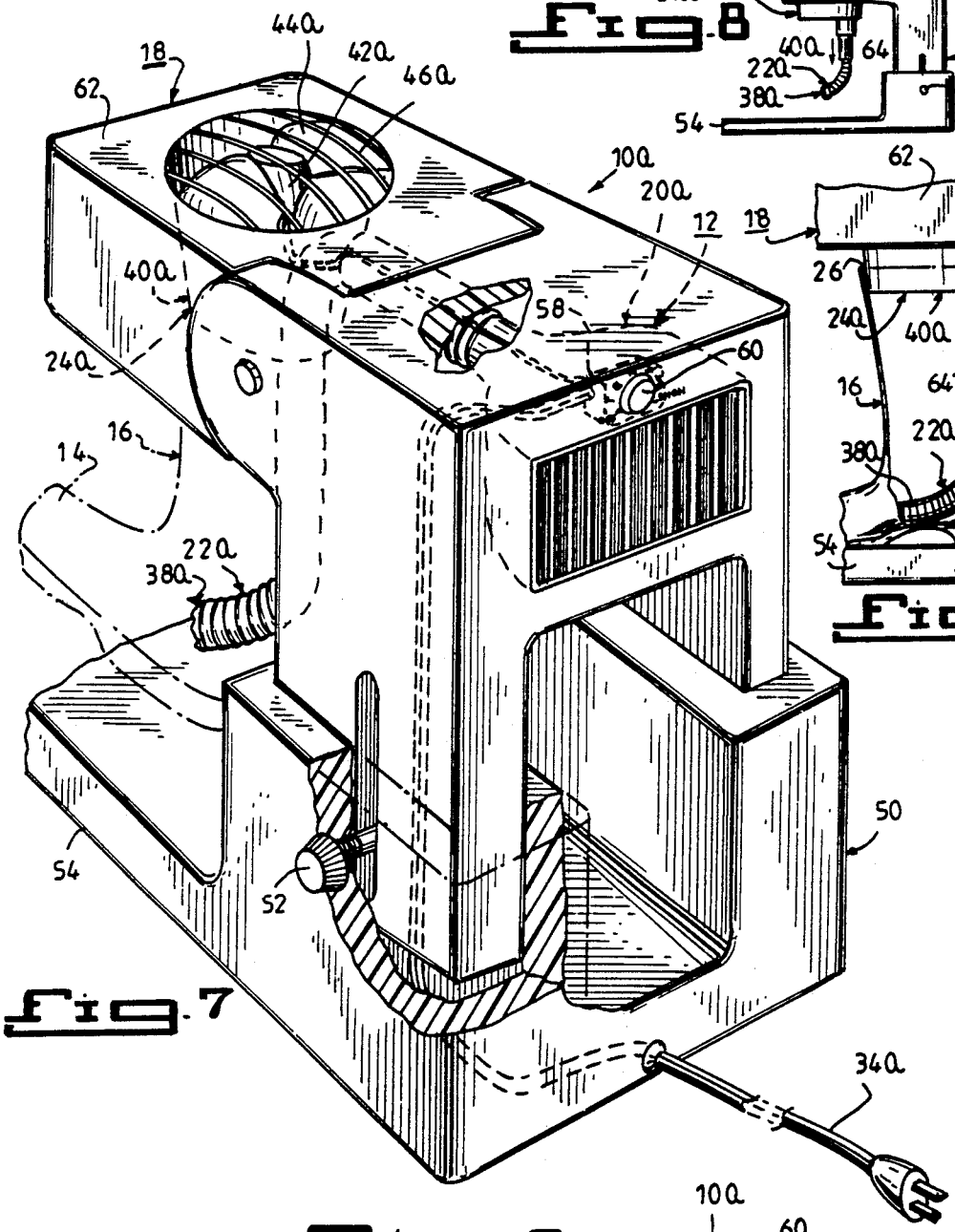
FIG. 7 is a rear perspective view with parts broken away of the second embodiment.
Figure 7A:
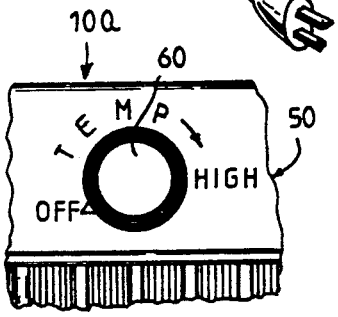
FIG. 7A is a rear view of a portion of the second embodiment showing the temperature control knob in greater detail.

As shown in FIGS. 8 and 9, the flexible pipe 38*a* is spring biased at 64 at the housing 40*a* of the exhaust fan 24*a*, so as to be better positioned within the boot 16.

LIST OF REFERENCE NUMBERS

10 hot air boot dryer
10*a* hot air boot dryer
12 hot air applying mechanism
14 toe area
16 boot
18 hot air and moisture exhausting mechanism
20 hot air blower
20*a* hot air blower
22*a* elongated conduit
24 exhaust fan
24*a* exhaust fan
26 open top of 16
27 electric hair dryer
28 motor and heating coil housing
30 handle
32 barrel
34 electric cord
34*a* electric cord
36 plug on 34
36*a* plug
38 flexible pipe for 22
38*a* flexible pipe of 22*a*
40 housing of 24
40*a* housing of 24*a*
42 motor
42*a* motor
44 fan blade
44*a* fan blade
46 grill
46*a* grill
48 flared end of 38
50 height adjustable housing
52 locking mechanism
54 base member
56 pivoting mechanism
58 rheostat
60 control knob
62 frame member
64 spring biased It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hot air boot dryer which comprises:

means for applying hot air within the interior and towards a toe area of a boot to remove moisture therefrom; and means for exhausting the hot air and moisture out of the boot, so that the interior of the boot can become dry;

said hot air applying means including a blower for producing the hot air, and an elongated conduit for carrying the hot air within the interior and towards the toe area of the boot;

said hot air and moisture exhausting means including an exhaust fan insertable into an open top of the boot, so as to blow the hot air and moisture out of the boot;

said hot air blower of said hot air applying means is an electric hair dryer comprising: a motor and heating coil housing, a handle extending from one side of said motor and heating coil housing, a barrel extending from another side of said motor and heating coil housing, an electric cord connected to a motor and heating coil within said motor and heating coil housing and extending outwardly from the bottom of said handle, and a plug on the distal end of said electric cord to connect to a power source;

said elongated conduit is a flexible pipe extending from an end of said barrel of said electric hair dryer and through said exhaust fan.

2. A hot air boot dryer as recited in claim 1, wherein said exhaust an includes:

a) a housing to fit into the top of the boot;
b) a motor mounted within said housing;
c) a plurality of fan blades driven by said motor; and
d) a grill to cover the top end of said housing.

3. A hot air boot dryer as recited in claim 2, wherein said housing is an inverted frustrum cone shaped configuration with said grill mounted to the wide top end thereof, so that the narrow bottom end can be inserted into the open top of any one of a number of all types of different sized boots.

4. A hot air boot dryer as recited in claim 3, wherein the lower end of said flexible pipe is flared outwardly, so as to further send the hot air up into the toe area within the boot.

5. A hot air boot dryer as recited in claim 3, further including:

a) a height adjustable housing to encase said hot air blower therein;
b) means for locking said height adjustable housing in position;
c) a base member extending from the bottom of said height adjustable housing, so that the boot can be placed upon said base member; and
d) means for pivoting said exhaust fan to the top of said height adjustable housing, so that said exhaust fan can pivot down into the open top of the boot and can pivot up to release the boot.

6. A hot air boot dryer as recited in claim 5, further including:

a) a rheostat electrically connected to said hot air blower;

b) a control knob connected to said rheostat on said housing for operating said rheostat;

c) an electric cord connected to said rheostat and extending outwardly from said base member; and d) a plug on the distal end of said electric cord to connect to a power source.

7. A hot air boot dryer as recited in claim 6, wherein said elongated conduit is a flexible pipe extending from an end of said hot air blower and through said exhaust fan.

8. A hot air boot dryer as recited in claim 7, wherein said exhaust fan includes:

a) a frame member connected to said pivoting means;

b) a housing formed on and extending downwardly from said frame member to fit into the top of the boot;

c) a motor mounted within said housing:

d) a plurality of fan blades driven by said motor: and e) a grill to cover the top end of said housing in said frame member.

9. A hot air boot dryer as recited in claim 8, wherein said housing is an inverted frustrum cone shaped configuration with said grill mounted to the wide top end thereof on said frame member, so that the narrow bottom end can be inserted into the open top of any one of a number of all types of different sized boots.

10. A hot air boot dryer as recited in claim 9, wherein said flexible pipe is spring biased at said housing of said exhaust fan, so as to be better positioned within the boot.

* * * * *